US011306627B2

(12) United States Patent
Kim et al.

(10) Patent No.: US 11,306,627 B2
(45) Date of Patent: Apr. 19, 2022

(54) CONTINUOUS VARIABLE VALVE DURATION APPARATUS AND ENGINE PROVIDED WITH THE SAME

(71) Applicants: Hyundai Motor Company, Seoul (KR); Kia Motors Corporation, Seoul (KR)

(72) Inventors: Hyeon Woo Kim, Seoul (KR); Kyoung Pyo Ha, Seongnam-si (KR); Back Sik Kim, Osan-si (KR); Jong Gu Kim, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 17/113,009

(22) Filed: Dec. 5, 2020

(65) Prior Publication Data

US 2022/0010701 A1 Jan. 13, 2022

(30) Foreign Application Priority Data

Jul. 8, 2020 (KR) ..... 10-2020-0084112

(51) Int. Cl.
*F01L 1/34* (2006.01)
*F01L 13/00* (2006.01)
(Continued)

(52) U.S. Cl.
CPC ..... *F01L 13/0015* (2013.01); *F01L 1/047* (2013.01); *F01M 11/02* (2013.01)

(58) Field of Classification Search
CPC ..... F01L 13/0015; F01L 1/047; F01M 11/02
See application file for complete search history.

(56) References Cited

U.S. PATENT DOCUMENTS 8,813,704 B2 8/2014 Kim et al.
9,512,748 B2 12/2016 Kim et al.
(Continued)

FOREIGN PATENT DOCUMENTS

DE 10 2015 119 782 A1 6/2016
EP 3 486 441 A1 5/2019

OTHER PUBLICATIONS

European Extended Search Report for European Patent Application No. EP 20211548.1 dated May 26, 2021.

*Primary Examiner* — Zelalem Eshete
(74) *Attorney, Agent, or Firm* — Morgan, Lewis & Bockius LLP

(57) ABSTRACT

A continuously variable valve duration apparatus may include a camshaft, a cam unit on which a cam is formed, wherein the camshaft is inserted into the cam unit, first and second guide brackets into which the camshaft is inserted, a wheel housing movably mounted to the first guide bracket and the second guide bracket, respectively, an internal wheel rotatably provided on each wheel housing and transmitting rotation of the camshaft to the cam unit, a worm wheel mounted on the first guide bracket and the second guide bracket, respectively to engage the wheel housing, a control shaft which is rotatably mounted on the first guide bracket and the second guide bracket, and engages with the each worm wheel to move the position of the wheel housing according to its rotation, and a connecting member that connects the first guide bracket and the second guide bracket.

18 Claims, 17 Drawing Sheets

(51) Int. Cl.
*F01L 1/047* (2006.01)
*F01M 11/02* (2006.01)

(56) References Cited

U.S. PATENT DOCUMENTS

| | | | | |
|---|---|---|---|---|
| 9,574,467 | B2 | 2/2017 | Ha | |
| 9,869,215 | B2 | 1/2018 | Son et al. | |
| 10,060,306 | B2 * | 8/2018 | Son | F01L 13/0015 |
| 2016/0160702 | A1 | 6/2016 | Son et al. | |
| 2017/0089230 | A1 | 3/2017 | Son et al. | |
| 2018/0100444 | A1 | 4/2018 | Ryu et al. | |

* cited by examiner

CONTINUOUS VARIABLE VALVE DURATION APPARATUS AND ENGINE PROVIDED WITH THE SAME

CROSS-REFERENCE TO RELATED APPLICATION

The present application claims priority to Korean Patent Application No. 10-2020-0084112 filed on Jul. 8, 2020, the entire contents of which is incorporated herein for all purposes by this reference.

BACKGROUND OF THE INVENTION

Field of the Invention

The present invention relates to a continuously variable valve duration apparatus and an engine provided with the same. The present invention relates to a continuously variable valve duration apparatus an engine provided with the same which may vary opening duration of a valve according to operation conditions of an engine with a simple construction.

Description of Related Art

An internal combustion engine generates power by combusting fuel in a combustion chamber in an air media drawn into the chamber. Intake valves are operated by a camshaft in order to intake the air, and the air is drawn into the combustion chamber while the intake valves are open. Furthermore, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuously variable valve lift (CVVL) that can change valve lift according to engine speed, have been undertaken.

Also, to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

The information included in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are direct to providing a continuously variable valve duration apparatus and an engine provided with the same which may vary opening duration of a valve according to operation conditions of an engine and reduce noise and vibration.

A continuously variable valve duration apparatus according to various exemplary embodiments of the present invention may include a camshaft, a cam unit on which a cam is formed, wherein the camshaft is inserted into the cam unit, first and second guide brackets into which the camshaft is inserted, a wheel housing movably mounted to the first guide bracket and the second guide bracket, respectively, an internal wheel rotatably provided on each wheel housing and transmitting rotation of the camshaft to the cam unit, a worm wheel mounted on the first guide bracket and the second guide bracket, respectively to engage the wheel housing, a control shaft which is rotatably mounted on the first guide bracket and the second guide bracket, and engages with the each worm wheel to move the position of the wheel housing according to its rotation, and a connecting member that connects the first guide bracket and the second guide bracket.

A control shaft hole in which the control shaft may be rotatably mounted is formed in the first guide bracket and the second guide bracket, and the control shaft may be inserted inside the connecting member, and the connecting member is mounted in the control shaft hole.

The continuously variable valve duration apparatus may further include an oil exhaust hole from which oil is exhausted is formed at the connecting member.

The continuously variable valve duration apparatus may further include an upper guide boss formed on the first guide bracket and the second guide bracket, respectively, a guide shaft, which is movably inserted into the upper guide boss and formed with a guide thread, formed at the wheel housing, an internal thread formed on an inside of the worm wheel and engaged with the guide thread, and an external thread formed on an outside of the worm wheel, and a control worm formed on the control shaft and engaging with the external thread.

The continuously variable valve duration apparatus may further include a thrust bearing mounted on the upper guide boss to support the worm wheel, respectively.

The continuously variable valve duration apparatus may further include a worm cap coupled to the first guide bracket and the second guide bracket to support the thrust bearing respectively.

The continuously variable valve duration apparatus may further include a control shaft bearing mounted on the control shaft hole to support rotation of the control shaft, respectively.

The continuously variable valve duration apparatus may further include a lower guide boss formed on the first guide bracket and the second guide bracket, respectively, and a guide rod formed on the wheel housing and inserted into the lower guide boss to guide a movement of the wheel housing.

A center portion of the internal wheel may deviate from an imaginary line connecting the upper guide boss and the lower guide boss.

The continuously variable valve duration apparatus may further include an upper stopper and a lower stopper respectively formed at the wheel housing to limit a movement of the wheel housing in contact with the first guide bracket and the second guide bracket.

The continuously variable valve duration apparatus may further include a bracket oil hole formed at the first guide bracket and the second guide bracket to supply lubrication oil to each worm wheel mounted on the first guide bracket and the second guide bracket, respectively.

The continuously variable valve duration apparatus may further include a first sliding hole and a second sliding hole respectively formed at the internal wheel, a cam slot formed at the cam unit, a roller wheel connected to the camshaft and rotatably inserted into the first sliding hole, and a roller cam slidably inserted into the cam slot and rotatably inserted into the second sliding hole.

The roller cam may include a roller cam body slidably inserted into the cam slot, a cam head rotatably inserted into the second sliding hole, and a protrusion configured to inhibit the roller cam from being removed from the internal wheel.

The roller wheel may include a wheel body slidably connected to the camshaft, and a wheel head rotatably inserted into the first sliding hole.

The continuously variable valve duration apparatus may further include a camshaft oil hole formed within the camshaft in a longitudinal direction thereof, a body oil hole formed at the wheel body of the roller wheel and configured to communicate with the camshaft oil hole, and an oil groove formed at the wheel head of the roller wheel and configured to communicate with the body oil hole.

The cam unit may include a first cam portion and a second cam portion which are disposed corresponding to a cylinder and an adjacent cylinder respectively, and the internal wheel may include a first internal wheel and a second internal wheel configured to transmit the rotation of the camshaft to the first cam portion and the second cam portion, respectively.

The first internal wheel and the second internal wheel may be connected rotatable to each other.

The continuously variable valve duration apparatus may further include a first bearing and a second bearing internally mounted within the wheel housing and supporting the first internal wheel and the second internal wheel, respectively.

An engine according to various exemplary embodiments of the present invention may be provided with the continuously variable valve duration apparatus.

As described above, a continuously variable valve duration apparatus according to various exemplary embodiments of the present invention may vary an opening duration of a valve according to operation conditions of an engine, with a simple construction.

The continuously variable valve duration apparatus according to various exemplary embodiments of the present invention may be reduced in size and thus the entire height of a valve train may be reduced.

Since the continuously variable valve duration apparatus may be applied to an existing engine without excessive modification, thus productivity may be enhanced and production cost may be reduced.

The continuously variable valve duration apparatus according to various exemplary embodiments of the present invention can reduce noise and vibration by applying a wheel elastic portion even if there is a production error in the parts.

The continuously variable valve duration device according to various exemplary embodiments of the present invention is easy to assemble by connecting each guide bracket, and vibration and noise reduction effects can be obtained.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
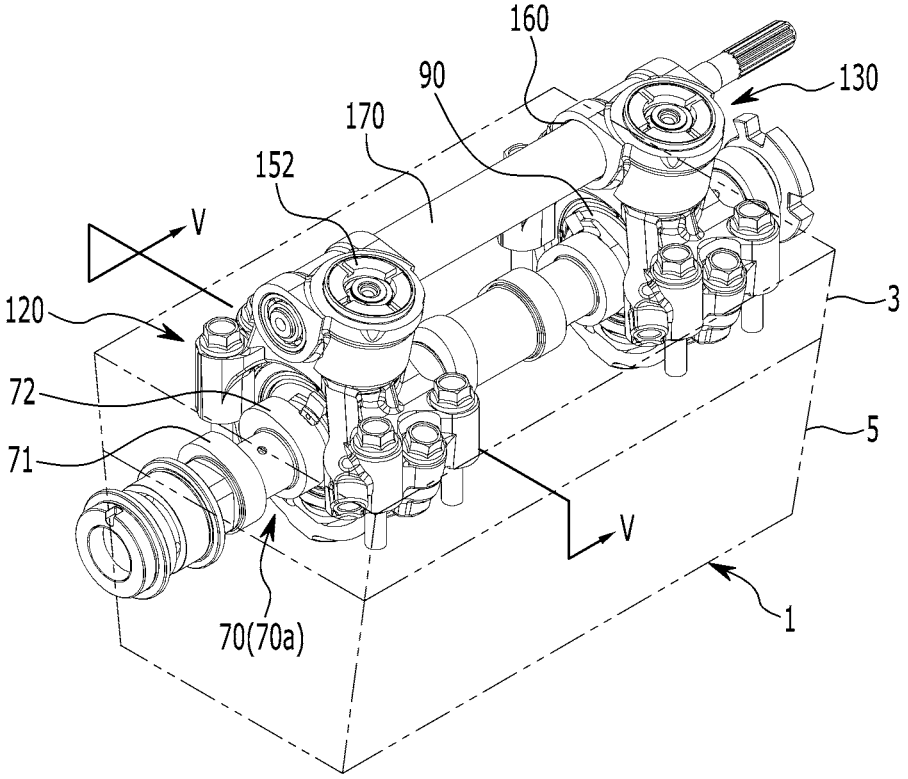
FIG. 1 is a perspective view of an engine provided with a continuously variable valve duration apparatus according to various exemplary embodiments of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention Parts marked with the same reference number throughout the specification mean the same constituent elements.

In the drawings, the thickness of layers, films, panels, regions, etc., are exaggerated for clarity.

Throughout the specification, unless explicitly described to the contrary, the word "comprise", and variations such as "comprises" or "comprising", will be understood to imply the inclusion of stated elements but not the exclusion of any other elements.

Various exemplary embodiments of the present invention will hereinafter be described in detail with reference to the accompanying drawings.

Figure 2:
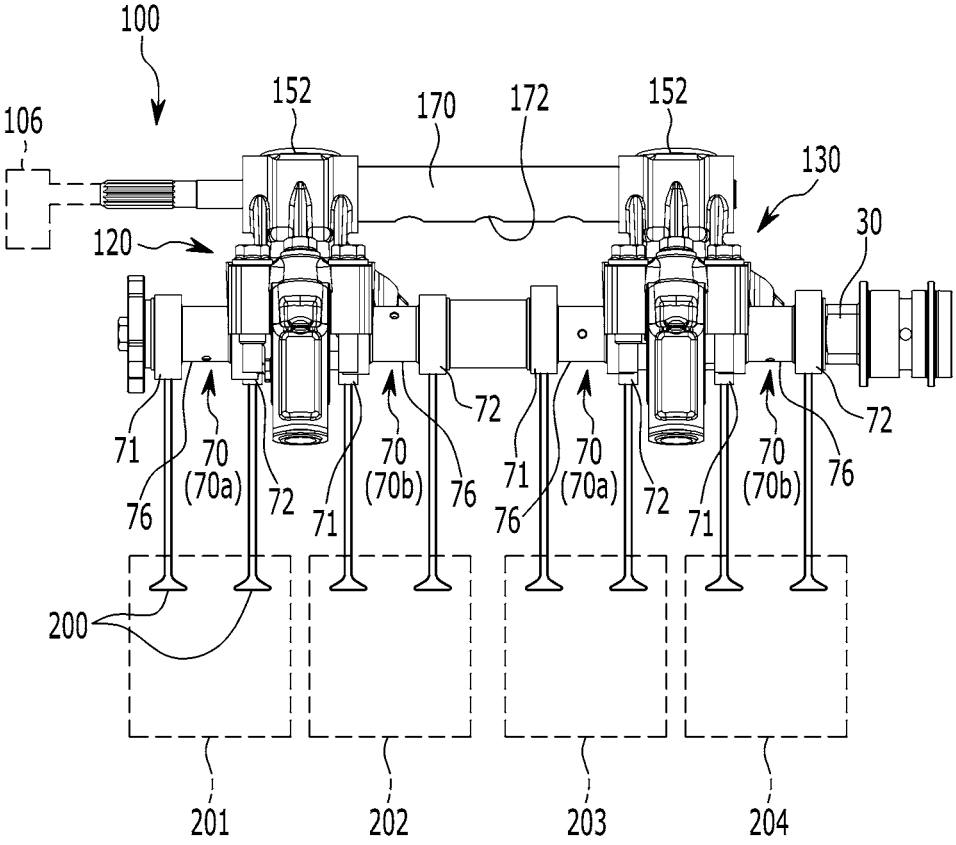
FIG. 2 is a side view of a continuously variable valve duration apparatus according to various exemplary embodiments of the present invention.

FIG. 1 is a perspective view of an engine provided with a continuously variable valve duration apparatus according to various exemplary embodiments of the present invention, and FIG. 2 is a side view of a continuously variable valve duration apparatus according to various exemplary embodiments of the present invention.

Figure 3:
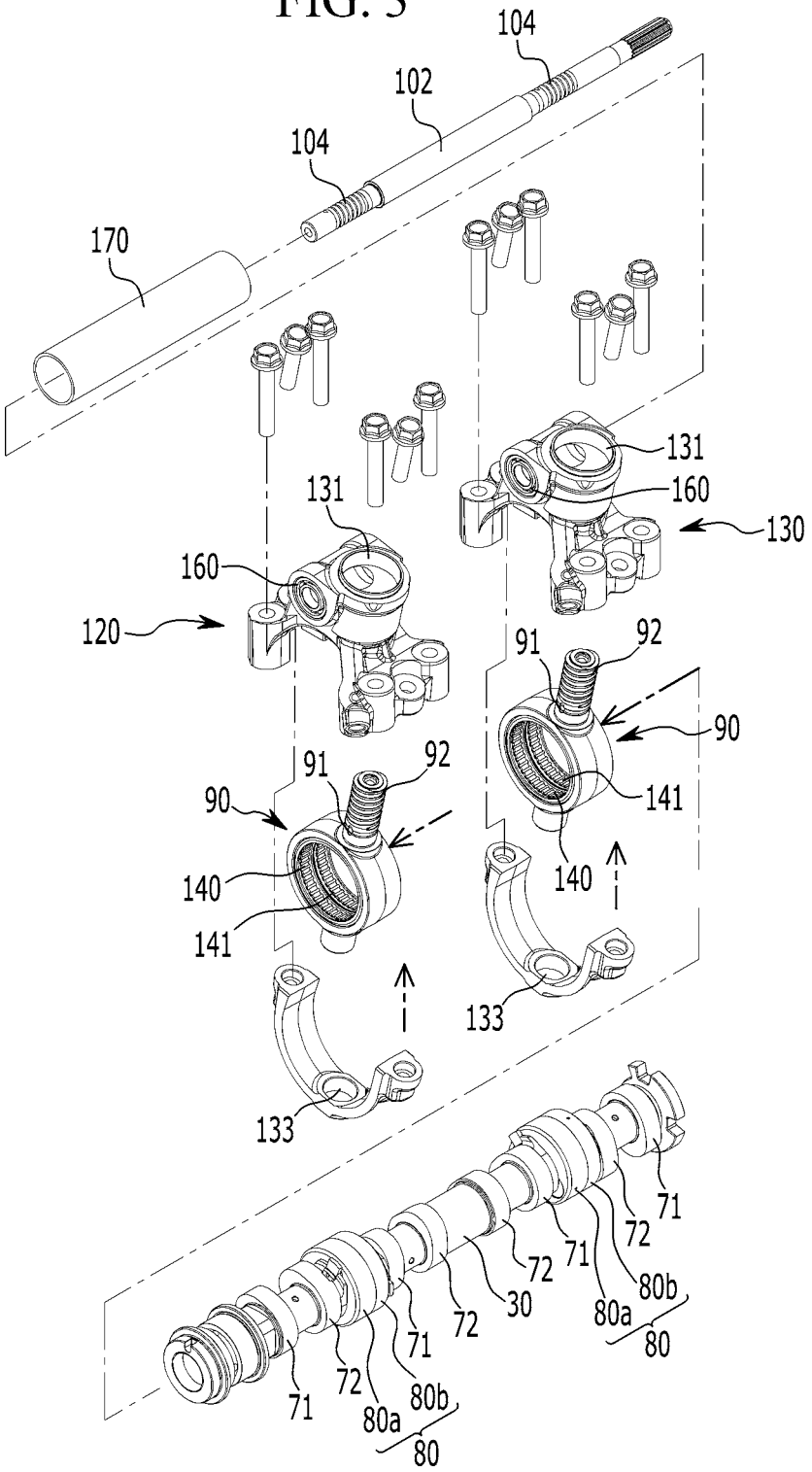
FIG. 3 is an exploded perspective view of a continuously variable valve duration apparatus according to various exemplary embodiments of the present invention.
Figure 4:
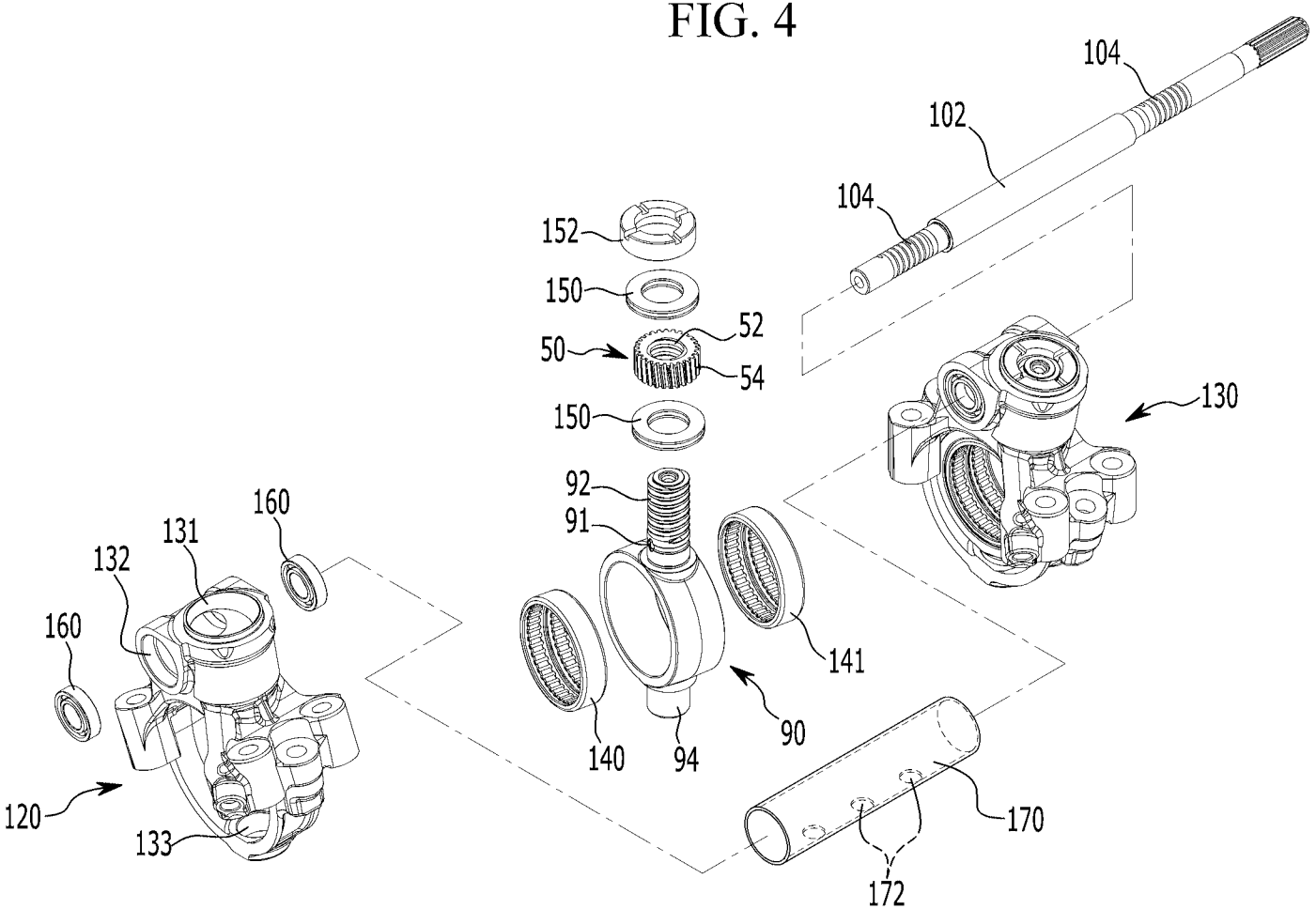
FIG. 4 is a partial perspective view of a continuously variable valve duration apparatus according to various exemplary embodiments of the present invention.

FIG. 3 is an exploded perspective view of a continuously variable valve duration apparatus according to various exemplary embodiments of the present invention, and FIG. 4 is a partial perspective view of a continuously variable valve duration apparatus according to various exemplary embodiments of the present invention.

Figure 5:
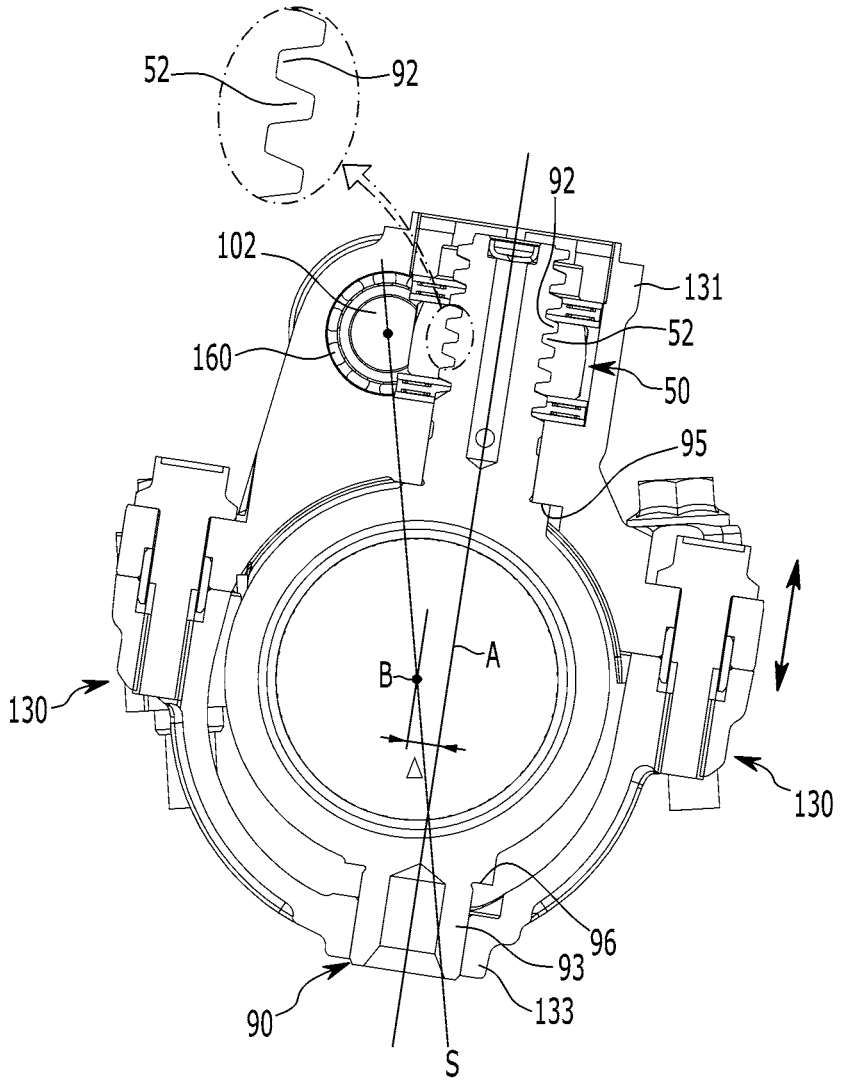
FIG. 5 is a cross-sectional view along line V-V of FIG. 1.
Figure 6:
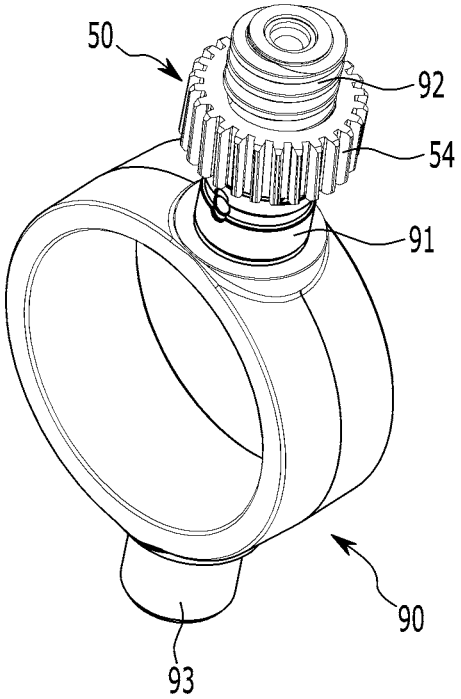
FIG. 6 is a perspective view of a wheel housing applied to a continuously variable valve duration apparatus according to various exemplary embodiments of the present invention.

FIG. 5 is a cross-sectional view along line V-V of FIG. 1, and FIG. 6 is a perspective view of a wheel housing applied to a continuously variable valve duration apparatus according to various exemplary embodiments of the present invention.

Referring to FIG. 1 to FIG. 6, an engine 1 according to various exemplary embodiments of the present invention includes a cylinder head 3, an engine block 5, and a continuously variable valve duration apparatus according to various exemplary embodiments of the present invention mounted on the cylinder head 3.

In the drawings, 4 cylinders 211, 212, 213 and 214 are formed at the engine, but it is not limited thereto.

A continuously variable valve duration apparatus according to various exemplary embodiments of the present invention may include a camshaft 30, a cam unit 70 on which a cam 71 is formed, and the camshaft 30 is inserted into the cam unit 70, first and second guide brackets 120 and 130 into which the camshaft 30 is inserted, a wheel housing 90 mounted movably to the first guide bracket and the second guide bracket 120 and 130, respectively, an internal wheel 80 rotatably provided on each wheel housing 90 and transmitting rotation of the camshaft 30 to the cam unit 70, a worm wheel 50 mounted on the first guide bracket and the second guide bracket 120 and 130 respectively to engage the wheel housing 90, and a control shaft 102 which is rotatably mounted on the first guide bracket and the second guide bracket 120 and 130, and engages with the each worm wheel 50 to move the position of the wheel housing 90 according to its rotation. Furthermore, the continuously variable valve duration apparatus according to various exemplary embodiments of the present invention further includes a connecting member 170 connecting the first guide bracket and the second guide bracket 120, and 130.

The camshaft 30 may be an intake camshaft or an exhaust camshaft.

In the first guide bracket and the second guide bracket 120, and 130, a control shaft hole 132 in which the control shaft 102 is rotatably mounted is formed, the control shaft 102 is inserted inside the connecting member 170, and the connecting member 170 can be mounted to the control shaft hole 132.

An oil exhaust hole 172 through which oil is exhausted may be formed at the connecting member 170.

The connecting member 170 can be press-fitted into the first guide bracket and the second guide bracket 120, and 130 to be coupled, and the first guide bracket and the second guide bracket 120, and 130 are connected in the assemble process by connecting the first guide bracket and the second guide bracket 120, and 130. It prevents relative distortion, and accurate position adjustment is possible. Furthermore, the connecting member 170 may connect the first guide bracket and the second guide bracket 120, and 130 to suppress the occurrence of noise or vibration.

The continuously variable valve duration apparatus may further include an upper guide boss 131 formed on the first guide bracket and the second guide bracket 120 and 130 respectively, a guide shaft 91, which is movably inserted into the upper guide boss 131 and formed with a guide thread 92, formed at the wheel housing 90, an internal thread 52 engaging the guide thread 92 formed on the inside of the worm wheel 50, and an external thread 54 formed on the outside of the worm wheel 50, and a control worm 104 engaging the external thread 54 formed on the worm wheel 50.

Each of the control shaft bearing 160 is mounted in the control shaft hole 132 to support rotation of the control shaft 102.

A thrust bearing 150 is mounted on the upper guide boss 131 to support the worm wheel 50, and as shown in the drawing, the thrust bearing 150 may be mounted above and below the worm wheel 50, respectively.

A worm cap 152 may be coupled to the first guide bracket and the second guide bracket 120, and 130 respectively to support the thrust bearing 150. For example, the worm cap 152 may be coupled to the first guide bracket and the second guide bracket 120, and 130 by caulking.

Referring to FIG. 5, the internal thread 52 and the guide thread 92 of the worm wheel 50 may be trapezoidal threads.

The thrust bearing 150 allows the worm wheel 50 to rotate smoothly, and the worm cap 152 fixes the position of the worm wheel 50.

Therefore, the worm wheel 50 is mounted at a fixed position of the first guide bracket and the second guide bracket 120, and 130, and the wheel housing 90 can move smoothly in the up and down directions of the drawing according to the rotation of the worm wheel 50.

A lower guide boss 133 is formed at the first guide bracket and the second guide bracket 120, and 130 respectively, and a guide rod 94 inserted into the lower guide boss 133 is formed at the wheel housing 90 to guide a movement of the wheel housing 90. The guide rod 94 guides the movement of the wheel housing 90 and prevents the wheel housing 90 from vibration.

A center portion B of the internal wheel 80 may be deviated from the imaginary line A connecting the upper guide boss 131 and the lower guide boss 133.

The camshaft 30 and the control shaft 102 can be mounted on a virtual vertical line S. Therefore, it is possible to prevent tool interference when engaging the cam cap with bolts.

Here, the virtual vertical line S phase does not mean that it is on a completely vertical line, but it is a practical vertical line (substantially vertical) phase, which means a configuration configured for minimizing interference when working through a tool.

The center portion B of the internal wheel 80 is offset (A) with the imaginary line A connecting the upper guide boss 131 and the lower guide boss 133, so even if a slight slope is provided to the valve duration apparatus, the camshaft 30 and the control shaft 102 can be mounted on the virtual vertical line S.

In an exemplary embodiment of the present invention, the imaginary line A is aligned along a center axis of the upper guide boss 131 and a center axis of the lower guide boss 133.

An upper stopper 95 and a lower stopper 96 contacting with the first guide bracket and the second guide bracket 120, and 130 are formed at the wheel housing 90 to limit a movement of the wheel housing 90.

Figure 7:
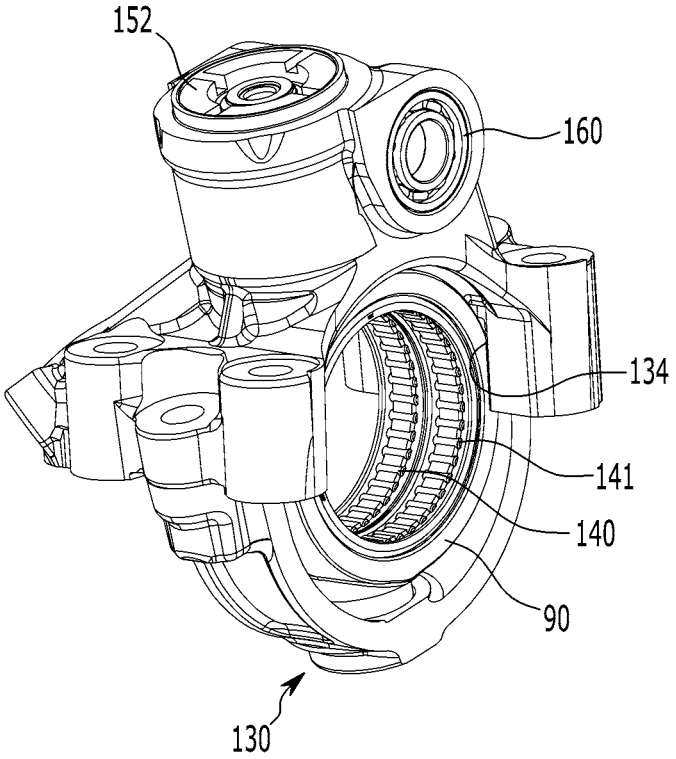
FIG. 7 is a perspective view of a guide bracket applied to a continuously variable valve duration apparatus according to various exemplary embodiments of the present invention.

FIG. 7 is a perspective view of a guide bracket applied to a continuously variable valve duration apparatus according to various exemplary embodiments of the present invention.

Referring to FIG. 7, a stepped surface 134 that prevents rotation of the wheel housing 90 is formed at the first guide bracket and the second guide bracket 120 and 130.

In the first guide bracket and the second guide bracket 120, and 130 the upper guide boss 131 and the lower guide boss 133 are formed, so that the wheel housing 90 rotates during operation of the instrument, which may cause uneven wear.

According to various exemplary embodiments of the present invention, the stepped surface 134 is formed on the first guide bracket and the second guide bracket 120, and 130, especially formed on the boss for engaging bolts on the side, reducing the number of parts and preventing rotation of the wheel housing 90.

Figure 8:
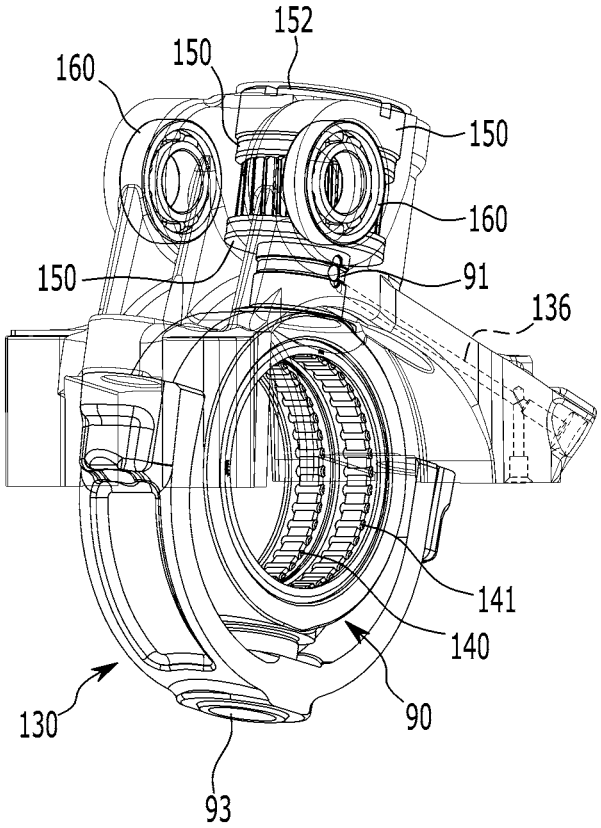
FIG. 8 is a partial projection view of a guide bracket applied to a continuously variable valve duration apparatus according to various exemplary embodiments of the present invention.

FIG. 8 is a partial projection view of a guide bracket applied to a continuously variable valve duration apparatus according to various exemplary embodiments of the present invention.

Referring to FIG. 8, a bracket oil hole 136 that supplies lubrication oil to the worm wheel 50 may be formed at the first guide bracket and the second guide bracket 120 and 130.

In various exemplary embodiments of the present invention, the control shaft bearing 160 and the worm cap 152 form a single chamber and supply oil to the worm wheel 50 through the bracket oil hole 136. It is possible to minimize the oil pressure loss and supply oil appropriate to each part. Furthermore, oil supplied to the worm wheel 50 may be delivered to the control shaft 102, and the oil delivered to the control shaft 102 may be exhausted through the oil exhaust hole 172 of the connecting member 170.

Figure 9:
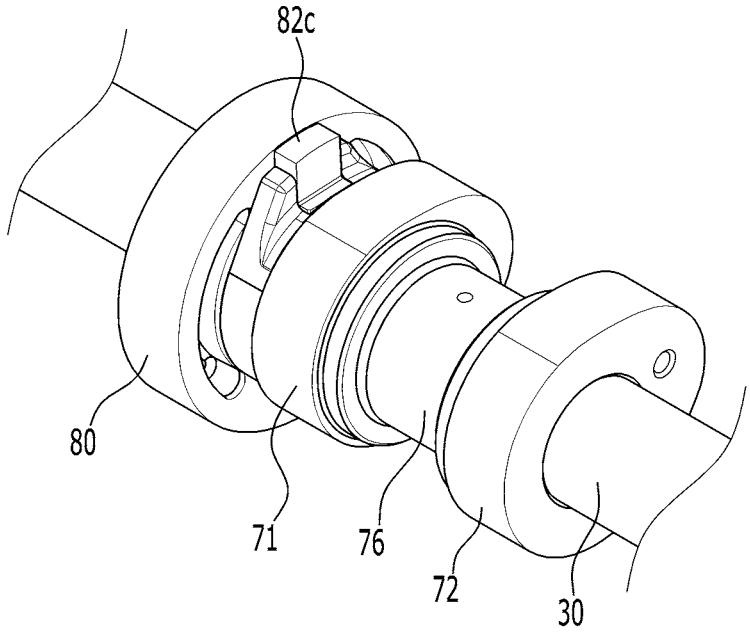
FIG. 9 is a perspective view showing an internal wheel and a cam unit applied to a continuously variable valve duration apparatus according to various exemplary embodiments of the present invention.
Figure 10:
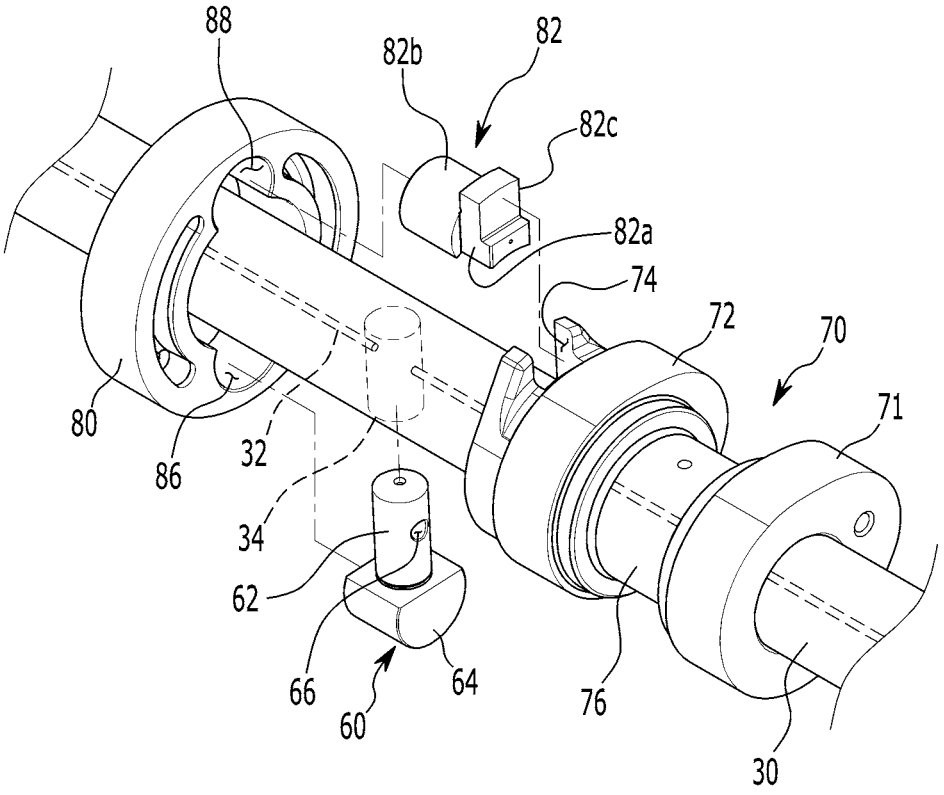
FIG. 10 is an exploded perspective view showing an internal wheel and a cam unit applied to a continuously variable valve duration apparatus according to various exemplary embodiments of the present invention.

FIG. 9 is a perspective view showing an internal wheel and a cam unit applied to a continuously variable valve duration apparatus according to various exemplary embodiments of the present invention.

Referring to FIG. 1 to FIG. 10, first and second sliding holes 86 and 88 are formed at the internal wheel 80, and cam slot 74 is formed at the cam unit 70.

The continuously variable valve duration apparatus further includes a roller wheel 60 connected to the camshaft 30 and rotatably inserted into the first sliding hole 86 and a roller cam 82 slidably inserted into the cam slot 74 and rotatably inserted into the second sliding hole 88.

The roller cam 82 includes a roller cam body 82*a* slidably inserted into the cam slot 74 and a cam head 82*b* rotatably inserted into the second sliding hole 88.

A protrusion 82*c* is formed at the roller cam 82 for preventing the roller cam 82 from being separated from the internal wheel 80 in the longitudinal direction of the camshaft 30.

The roller wheel 60 includes a wheel body 62 slidably connected to the camshaft 30 and a wheel head 64 rotatably inserted into the first sliding hole 86 and the wheel body 62 and the wheel head 64 may be integrally formed.

A camshaft hole 34 is formed at the camshaft 30, the wheel body 62 of the roller wheel 60 is movably inserted into the camshaft hole 34 and the wheel head 64 is rotatably inserted into the first sliding hole 86.

A camshaft oil hole 32 is formed within the camshaft 30 in a longitudinal direction thereof, a body oil hole 66 communicated with the camshaft oil hole 32 is formed at the wheel body 62 of the roller wheel 60 and an oil groove 68 (referring to FIG. 13) communicated with the body oil hole 66 is formed at the wheel head 64 of the roller wheel 60.

Lubricant supplied to the camshaft oil hole 32 may be supplied to the internal wheel 80 through the body oil hole 66, the communicate hole 69 and the oil groove 68.

Figure 11:
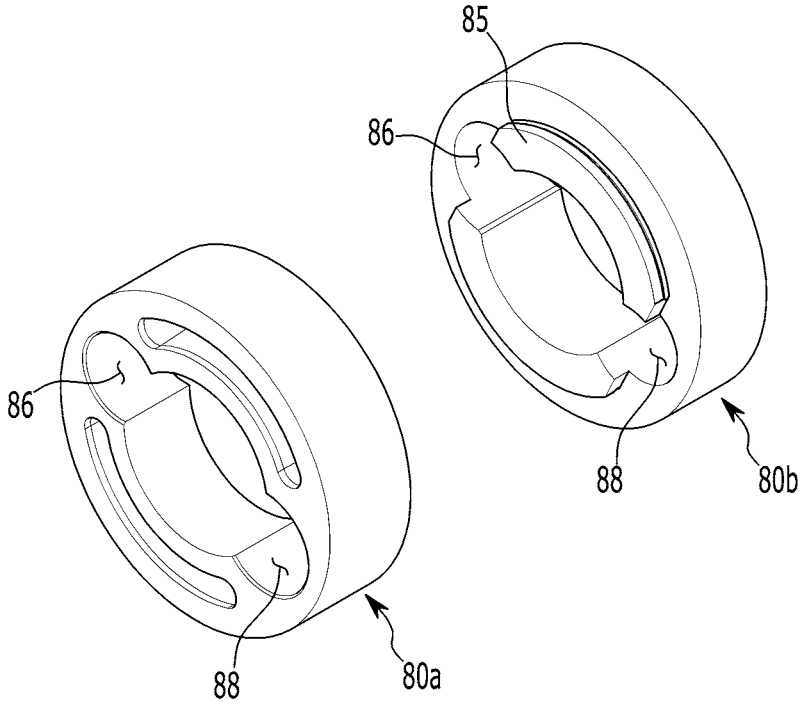
FIG. 11 is a perspective view of an internal wheel of a continuously variable valve duration apparatus according to various exemplary embodiments of the present invention.
Figure 12:
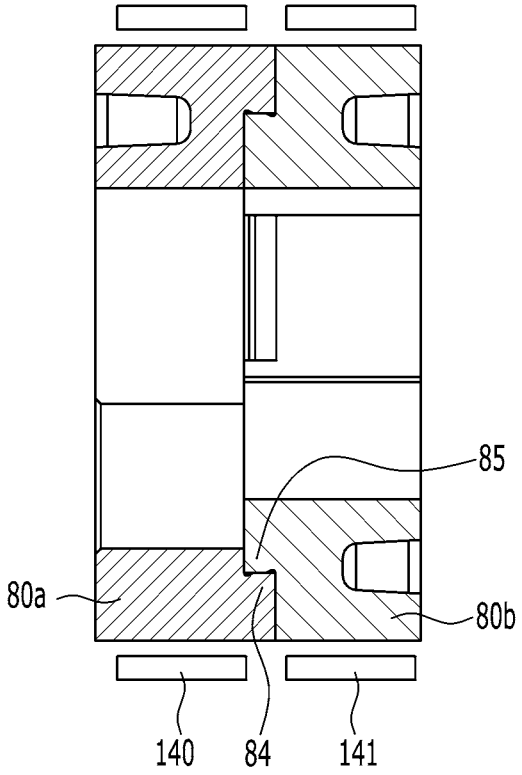
FIG. 12 is a cross-sectional view of an internal wheel of a continuously variable valve duration apparatus according to various exemplary embodiments of the present invention.

FIG. 11 is a perspective view of an internal wheel of a continuously variable valve duration apparatus according to various exemplary embodiments of the present invention, and FIG. 12 is a cross-sectional view of an internal wheel of a continuously variable valve duration apparatus according to various exemplary embodiments of the present invention.

Referring to FIG. 2, FIG. 11 and FIG. 12, the cam unit 70 includes a first cam portion 70*a* and a second cam portion 70*b* which are disposed corresponding to a cylinder and an adjacent cylinder respectively, for example the first cylinder 201 and the adjacent second cylinder 202 and the internal wheel 80 includes a first internal wheel 80*a* and a second internal wheel 80*b* transmitting rotation of the camshaft 30 to the first cam portion 70*a* and the second cam portion 70*b* respectively.

The continuously variable valve duration apparatus further includes first and second bearings 140, and 141*a* internally disposed within the wheel housing 90 for supporting the first internal wheel 80*a* and the second internal wheel 80*b*.

The first and second bearings 140, and 141*a* may be a needle bearing, the first and the second internal wheels 80*a* and 80*b* are internally disposed within one wheel housing 90 and the first and second bearings 140, and 141*a* may rotatably support the first and the second internal wheels 80*a* and 80*b*.

Since the first and the second internal wheels 80*a* and 80*b* may be internally disposed within one wheel housing 90, element numbers may be reduced, so that productivity and manufacturing economy may be enhanced.

The first internal wheel 80*a* and the second internal wheel 80*b* within the wheel housing 90 may be connected rotatable to each other. For example, a first internal wheel connecting portion 84 and a second internal wheel connecting portion 85 are formed at the first internal wheel 80*a* and the second internal wheel 80*b* respectively, and the first internal wheel connecting portion 84 and the second internal wheel connecting portion 85 are connected to each other.

In the drawing, the first internal wheel connecting portion 84 and the second internal wheel connecting portion 85 are formed as convex and concave, it is not limited thereto. The first internal wheel 80*a* and the second internal wheel 80*b* are connected rotatable to each other with variable connecting structures.

In the case that the first internal wheel 80*a* and the second internal wheel 80*b* are connected, looseness or vibration due to manufacturing tolerances of the bearing, the internal wheel, the lifter and so on may be reduced.

Two cams 71 and 72 may be formed on the first and the second cam portions 70*a* and 70*b* as a pair and a cam cap connecting portion 76 is formed between the paired cams 71 and 72 of each of the first and second cam portions 70*a* and 70*b*.

The cam 71 and 72 rotate and open the valve 200.

Figure 13:
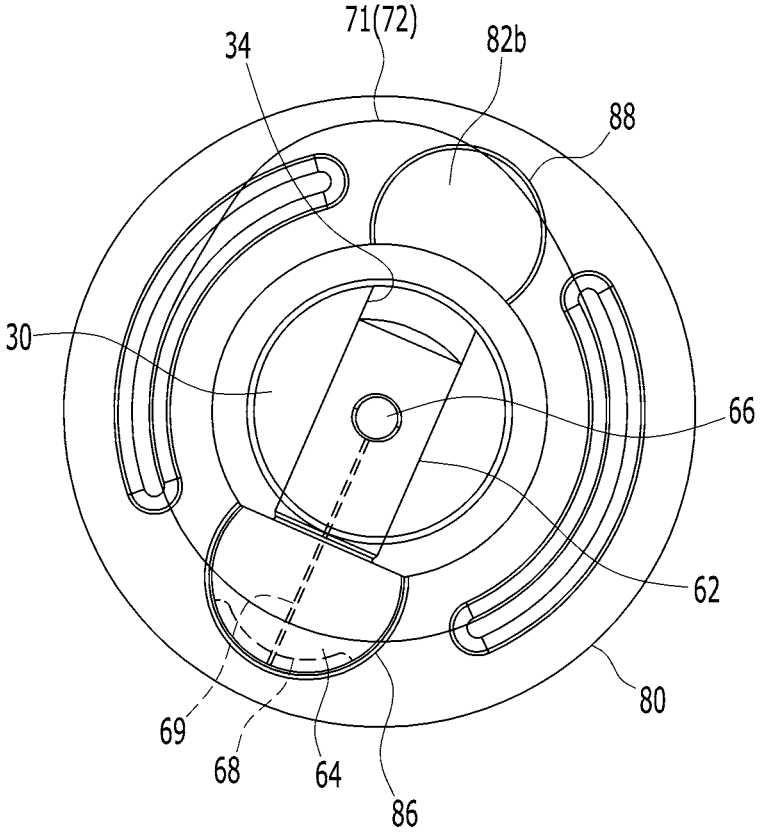
FIG. 13, FIG. 14 and FIG. 15 are drawings illustrating an operation of a continuously variable valve duration apparatus according to various exemplary embodiments of the present invention.
Figure 14:
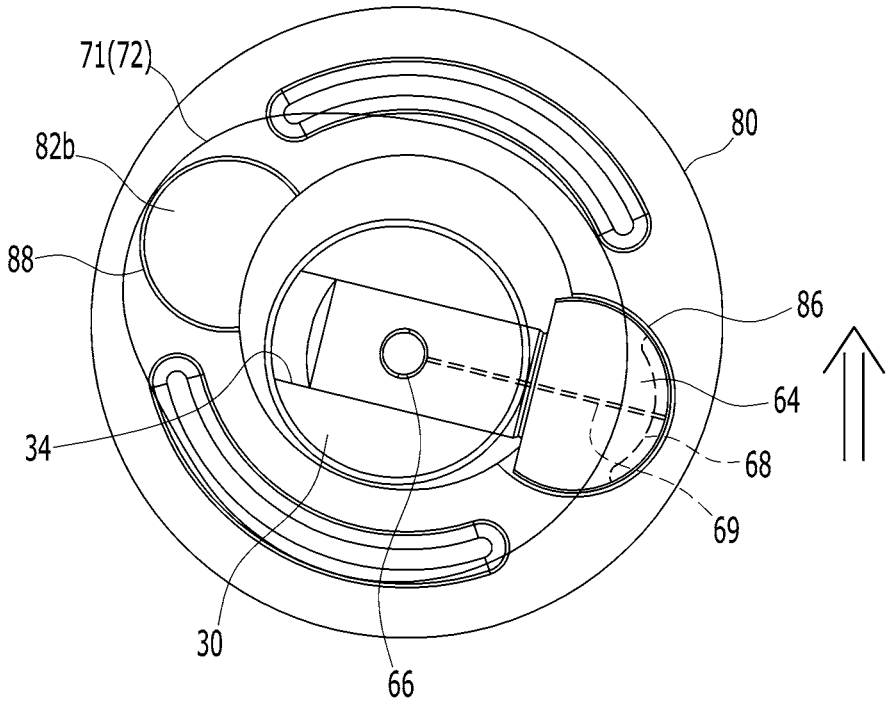
Figure 15:
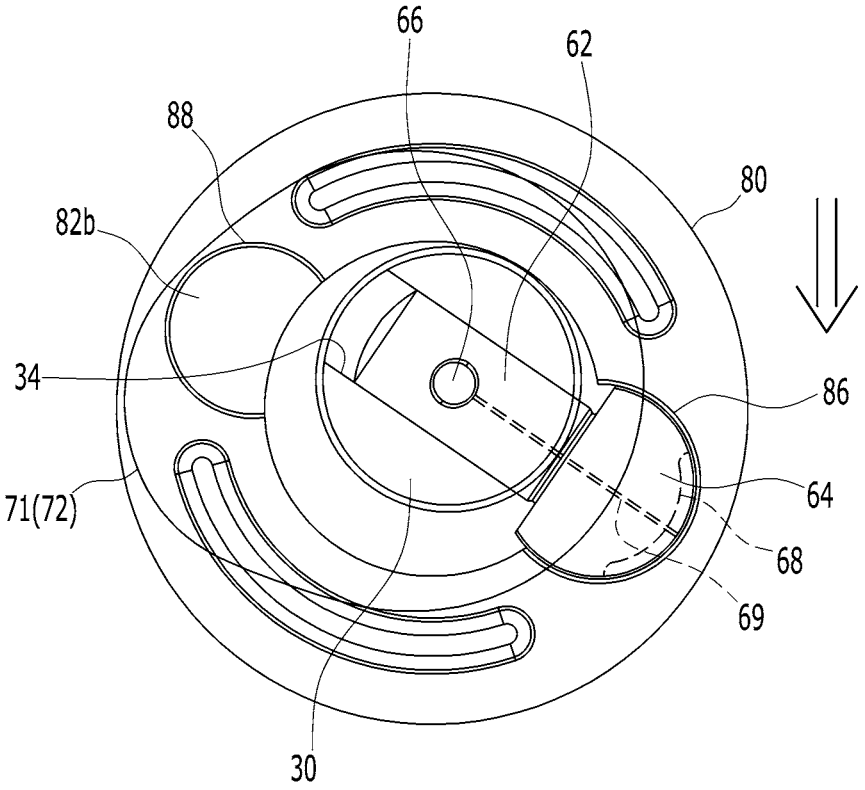

FIG. 13, FIG. 14 and FIG. 15 are drawings illustrating an operation of a continuously variable valve duration apparatus according to various exemplary embodiments of the present invention.

As shown in FIG. 13, when rotation centers of the camshaft 30 and the cam unit 70 are coincident, the cams 71 and 72 rotate with the same phase angle of the camshaft 30.

According to engine operation states, an ECU (engine control unit or electric control unit) transmits control signals to the control portion 100, and then the control motor 106 rotates the control shaft 102.

Referring to FIG. 5, FIG. 14 and FIG. 15, the control worm 104 engaged with the external thread 54 rotates the worm wheel 50 and since the internal thread 52 formed at the worm wheel 50 is engaged with the guide thread 130 and thus the worm wheel 50 moves along the guide thread 130.

That is, the worm wheel 50 rotates by the rotation of the control shaft 102 and changes the relative position of the wheel housing 90 to the camshaft 30.

When the position of the wheel housing 90 moves upper or lower relative to the rotation center portion of the camshaft 30, the relative rotation speed of the cams 71 and 72 with respect to the rotation speed of the camshaft 30 are changed.

While the slider pin 60 is rotated with the camshaft 30, the pin body 62 is slidable within the camshaft hole 34, the pin head 64 is rotatable within the first sliding hole 86, and the roller cam 82 is rotatably within the second sliding hole 88 and slidable within the cam slot 74. Thus, the relative rotation speed of the cams 71 and 72 with respect to the rotation speed of the camshaft 30 is changed.

Figure 16A:
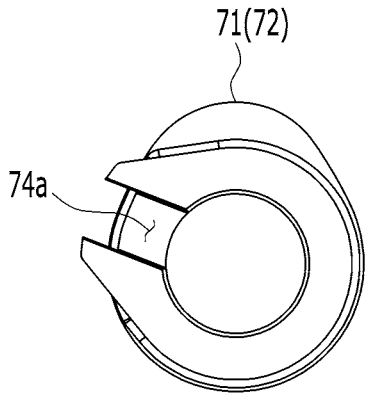
FIG. 16A and FIG. 16B are a drawing showing a cam slot of a continuously variable valve duration apparatus according to various exemplary embodiments of the present invention.
Figure 16B:
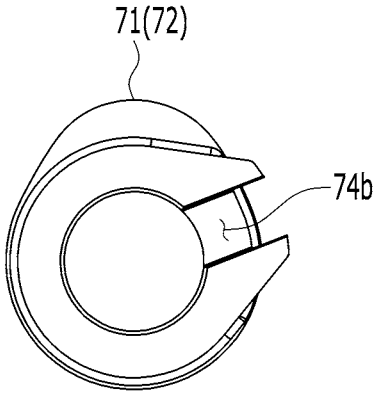
Figure 17A:
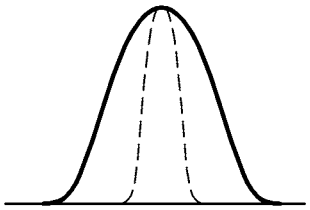
FIG. 17A, FIG. 17B and FIG. 17C are a graphs showing valve profile of a continuously variable valve duration apparatus according to various exemplary embodiments of the present invention.
Figure 17B:
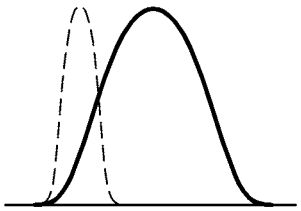
Figure 17C:
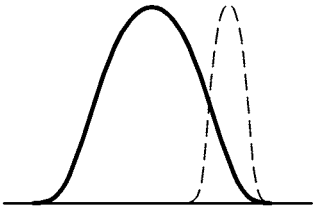

FIG. 16A and FIG. 16B are a drawing showing a cam slot of a continuously variable valve duration apparatus according to various exemplary embodiments of the present invention, and FIG. 17A, FIG. 17B and FIG. 17C are a graphs showing valve profile of a continuously variable valve duration apparatus according to various exemplary embodiments of the present invention.

As shown in FIG. 16A and FIG. 16B, the cam slot 74 may be formed more retarded than a position of the cam 71 or 72 (referring to FIG. 16A) or the cam slot 74 may be formed more advanced than a position of the cam 71 or 72 (referring to FIG. 16B), or the cam slot 74 may be formed with the same phase of the cam 71 or 72. With the above scheme, various valve profiles may be achieved.

Although maximum lift of the valve 200 is constant, however rotation speed of the cam 71 and 72 with respect to the rotation speed of the camshaft 30 is changed according to relative positions of the slider housing 90 so that closing and opening time of the valve 200 is changed. That is, duration of the valve 200 is changed.

According to the relative position of the cam slot 74, mounting angle of the valve 200 and so on, opening and closing time of the valve may be simultaneously changed as shown in FIG. 17A.

While opening time of the valve 200 is constant, closing time of the valve 200 may be retarded or advanced as shown in FIG. 17B.

While closing time of the valve 200 is constant, opening time of the valve 200 may be retarded or advanced as shown in FIG. 17C.

As described above, a continuously variable valve duration apparatus according to various exemplary embodiments of the present invention may achieve various valve duration with a simple construction.

The continuously variable valve duration apparatus according to various exemplary embodiments of the present invention may be reduced in size and thus the entire height of a valve train may be reduced.

Since the continuously variable valve duration apparatus may be applied to an existing engine without excessive modification, thus productivity may be enhanced and production cost may be reduced.

The continuously variable valve duration apparatus according to various exemplary embodiments of the present invention can reduce the number of portions and reduce vibration and noise by applying a worm wheel.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described in order to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A valve duration control apparatus comprising:

a camshaft;

a cam unit on which a cam is formed, wherein the camshaft is inserted into the cam unit;

a first guide bracket and a second guide bracket into which the camshaft is inserted;

a wheel housing movably mounted to the first guide bracket and the second guide bracket, respectively;

an internal wheel mounted on the camshaft and rotatably mounted on each wheel housing of the first guide bracket and the second guide bracket, wherein the internal wheel is configured of transmitting a rotation of the camshaft to the cam unit;

a worm wheel mounted on the first guide bracket and the second guide bracket, respectively to engage with each wheel housing;

a control shaft which is rotatably mounted on the first guide bracket and the second guide bracket, and engages with each worm wheel to move a position of the wheel housing according to rotation thereof; and a connecting member that connects the first guide bracket and the second guide bracket, wherein a control shaft hole in which the control shaft is rotatably mounted is formed in the first guide bracket and the second guide bracket, and wherein the control shaft is inserted inside the connecting member, and the connecting member is mounted in the control shaft hole.

2. The valve duration control apparatus of claim 1, further including an oil exhaust hole from which oil is exhausted is formed at the connecting member.

3. The valve duration control apparatus of claim 1, further including:

an upper guide boss formed on the first guide bracket and the second guide bracket, respectively;

a guide shaft formed at the wheel housing, wherein the guide shaft is movably inserted into the upper guide boss and formed with a guide thread;

an internal thread formed on an inside of the worm wheel and engaged with the guide thread, and an external thread formed on an outside of the worm wheel; and a control worm formed on the control shaft and engaging with the external thread.

4. The valve duration control apparatus of claim 3, further including a thrust bearing mounted on the upper guide boss to support the worm wheel, respectively.

5. The valve duration control apparatus of claim 4, further including a worm cap coupled to the first guide bracket and the second guide bracket to support the thrust bearing respectively.

6. The valve duration control apparatus of claim 1, further including a control shaft bearing mounted on the control shaft hole to support a rotation of the control shaft.

7. The valve duration control apparatus of claim 3, further including:

a lower guide boss formed on the first guide bracket and the second guide bracket, respectively; and a guide rod formed on the wheel housing and inserted into the lower guide boss to guide a movement of the wheel housing.

8. The valve duration control apparatus of claim 7, wherein a center portion of the internal wheel is aligned to deviate from an imaginary line connecting the upper guide boss and the lower guide boss.

9. The valve duration control apparatus of claim 1, further including an upper stopper and a lower stopper respectively formed at the wheel housing to limit a movement of the wheel housing in contact with the first guide bracket and the second guide bracket.

10. The valve duration control apparatus of claim 1, further including a bracket oil hole formed at the first guide bracket and the second guide bracket to supply lubrication oil to each worm wheel mounted on the first guide bracket and the second guide bracket, respectively.

11. The valve duration control apparatus of claim 1, further including:

a first sliding hole and a second sliding hole respectively formed at the internal wheel;

a cam slot formed at the cam unit;

a roller wheel connected to the camshaft and rotatably inserted into the first sliding hole; and a roller cam slidably inserted into the cam slot and rotatably inserted into the second sliding hole.

12. The valve duration control apparatus of claim 11, wherein the roller cam includes:

a roller cam body slidably inserted into the cam slot;

a cam head rotatably inserted into the second sliding hole; and a protrusion configured to inhibit the roller cam from being removed from the internal wheel.

13. The valve duration control apparatus of claim 11, wherein the roller wheel includes:

a wheel body slidably connected to the camshaft; and a wheel head rotatably inserted into the first sliding hole.

14. The valve duration control apparatus of claim 13, further including:

a camshaft oil hole formed within the camshaft in a longitudinal direction of the camshaft;

a body oil hole formed at the wheel body of the roller wheel and fluidically-communicating with the camshaft oil hole; and an oil groove formed at the wheel head of the roller wheel and fluidically-communicating with the body oil hole.

15. The valve duration control apparatus of claim 1, wherein the cam unit includes a first cam portion and a second cam portion which are disposed corresponding to a cylinder and an adjacent cylinder respectively; and wherein the internal wheel includes a first internal wheel and a second internal wheel configured to transmit the rotation of the camshaft to the first cam portion and the second cam portion, respectively.

16. The valve duration control apparatus of claim 15, wherein the first internal wheel and the second internal wheel are rotatably connected to each other.

17. The valve duration control apparatus of claim 15, further including a first bearing and a second bearing internally disposed within the wheel housing and supporting the first internal wheel and the second internal wheel, respectively.

18. An engine provided with the valve duration control apparatus of claim 1.

* * * * *